US009653279B2

(12) United States Patent
Brown et al.

(10) Patent No.: US 9,653,279 B2
(45) Date of Patent: May 16, 2017

(54) DEVICE ALLOWING IMPROVED REACTION MONITORING OF GAS PHASE REACTIONS IN MASS SPECTROMETERS USING AN AUTO EJECTION ION TRAP

(71) Applicant: Micromass UK Limited, Wilmslow (GB)

(72) Inventors: Jeffery Mark Brown, Hyde (GB); Martin Raymond Green, Bowdon (GB); Steven Derek Pringle, Darwen (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/768,392

(22) PCT Filed: Feb. 18, 2014

(86) PCT No.: PCT/GB2014/000058

§ 371 (c)(1),
(2) Date: Aug. 17, 2015

(87) PCT Pub. No.: WO2014/125247

PCT Pub. Date: Aug. 21, 2014

(65) Prior Publication Data

US 2015/0380232 A1 Dec. 31, 2015

(30) Foreign Application Priority Data

Feb. 18, 2013 (EP) ..... 13155630
Feb. 18, 2013 (GB) ..... 1302785.9

(51) Int. Cl.
*H01J 49/00* (2006.01)
*H01J 49/42* (2006.01)

(52) U.S. Cl.
CPC ..... *H01J 49/429* (2013.01); *H01J 49/422* (2013.01); *H01J 49/424* (2013.01); *H01J 49/428* (2013.01)

(58) Field of Classification Search
USPC ..... 250/283
See application file for complete search history.

(56) References Cited

U.S. PATENT DOCUMENTS 5,134,286 A 7/1992 Kelley
5,256,875 A 10/1993 Hoekman et al.
(Continued)

FOREIGN PATENT DOCUMENTS

GB 467466 6/1937
GB 2467466 12/2010
(Continued)

*Primary Examiner* — Phillip A Johnston
(74) *Attorney, Agent, or Firm* — Diederiks & Whitelaw, PLC

(57) ABSTRACT

A collision or reaction device for a mass spectrometer is disclosed comprising a first device arranged and adapted to cause first ions to collide or react with charged particles and/or neutral particles or otherwise dissociate so as to form second ions. A second device is arranged and adapted to apply a broadband excitation with one or more frequency notches to the first device so as to cause the second ions and/or ions derived from the second ions to be substantially ejected from the collision or reaction region. The collision or reaction device further comprises a device arranged and adapted to determine the time when the second ions and/or ions derived from the second ions are substantially ejected from the first device.

19 Claims, 2 Drawing Sheets

(56) References Cited

U.S. PATENT DOCUMENTS

| | | | | |
|---|---|---|---|---|
| 5,324,939 | A | 6/1994 | Louris et al. | |
| 6,815,673 | B2 | 11/2004 | Plomley et al. | |
| 6,833,544 | B1 | 12/2004 | Douglas et al. | |
| 6,891,157 | B2 * | 5/2005 | Bateman | H01J 49/065 250/292 |
| 6,924,478 | B1 | 8/2005 | Zubarev et al. | |
| 7,355,169 | B2 * | 4/2008 | McLuckey | H01J 49/0063 250/281 |
| 7,456,396 | B2 * | 11/2008 | Quarmby | H01J 49/427 250/282 |
| 8,076,637 | B2 * | 12/2011 | Pringle | H01J 49/428 250/281 |
| 8,164,052 | B2 | 4/2012 | Green et al. | |
| 8,237,106 | B2 | 8/2012 | Castro-Perez et al. | |
| 8,952,320 | B2 * | 2/2015 | Bateman | H01J 49/4215 250/281 |
| 9,196,466 | B2 | 11/2015 | Bateman | |
| 9,293,314 | B2 * | 3/2016 | Kenny | H01J 49/0059 |
| 2007/0181804 | A1 * | 8/2007 | Hashimoto | H01J 49/067 250/290 |
| 2009/0090860 | A1 | 4/2009 | Furuhashi et al. | |
| 2010/0276583 | A1 | 11/2010 | Senko | |
| 2013/0299693 | A1 | 11/2013 | Xia et al. | |

FOREIGN PATENT DOCUMENTS

| | | |
|---|---|---|
| GB | 2455692 | 8/2011 |
| GB | 2512474 | 1/2014 |
| GB | 2512473 | 1/2016 |
| WO | 02/054101 | 11/2002 |
| WO | 2012/051391 | 4/2012 |
| WO | 2013/098600 | 7/2013 |

* cited by examiner

DEVICE ALLOWING IMPROVED REACTION MONITORING OF GAS PHASE REACTIONS IN MASS SPECTROMETERS USING AN AUTO EJECTION ION TRAP

CROSS-REFERENCE TO RELATED APPLICATION

This application is the National Stage of International Application No. PCT/GB2014/000058, filed 18 Feb. 2014 which claims priority from and the benefit of United Kingdom patent application No. 1302785.9 filed on 18 Feb. 2013 and European patent application No. 13155630.0 filed 18 Feb. 2013. The entire contents of these applications are incorporated herein by reference.

BACKGROUND OF THE PRESENT INVENTION

The present invention relates to a collision or reaction device for a mass spectrometer, a mass spectrometer, a method of colliding or reacting ions and a method of mass spectrometry. The preferred embodiments relates to a gas phase reaction device that facilitates the removal of the gas phase reaction ionic products in a controlled manner. The gas phase reaction device may comprise an ion-ion, ion-electron, ion-molecule or ion-metastable reaction device.

GB-2467466 (Micromass) discloses a high transmission RF ion guide with no physical axial obstructions wherein an applied electrical field may be switched between two modes of operation. In a first mode of operation the device onwardly transmits a mass range of ions and in a second mode of operation the device acts as a linear ion trap in which ions may be mass selectively displaced in at least one radial direction and subsequently ejected adiabatically in the axial direction past one or more radially dependent axial DC barriers.

It is known that mass selective radial displacement may be achieved by arranging the frequency of a supplementary time varying field to be close to a mass dependent characteristic frequency of oscillation of a group of ions within the ion guide.

The characteristic frequency is the secular frequency of ions within the ion guide. The secular frequency of an ion within the device is a function of the mass to charge ratio of the ion and is approximated by the following equation (reference is made to P. H. Dawson, Quadrupole Mass Spectrometry and Its Applications) for an RF only quadrupole:

$$\omega\left(\frac{m}{z}\right) \approx \frac{\sqrt{2}\cdot z\cdot e\cdot V}{m\cdot R_0^2\cdot \Omega} \tag{1}$$

wherein m/z is the mass to charge ratio of the ion, e is the electronic charge, V is the peak RF voltage, $R_0$ is the inscribed radius of the rod set and ω is the angular frequency of the RF voltage.

It is known to provide a broadband excitation to a quadrupole ion guide with frequency components missing around the secular frequency of an ion. The frequency components which are missing are commonly referred to as notches. Multiple ions may be isolated in the ion guide by applying additional notches or missing frequencies.

U.S. Pat. No. 7,355,169 (McLuckey) discloses a method of peak parking. This method is based around allowing all reactant products to remain in an ion trap and only ejecting a known product ion and is specific to ion-ion reactions.

U.S. Pat. No. 5,256,875 (Hoekman) discloses a method of generating an optimised broadband filtered noise signal which may be applied to an ion trap. The broadband signal is filtered by a notch filter to generate a broadband signal whose frequency-amplitude has one or more notches. An arrangement is disclosed which enables rapid generation of different filtered noise signals.

FIG. 2 of WO 2012/051391 (Xia) relates to an arrangement wherein a broadband notched signal is applied to a linear ion trap having multiple frequency notches so as to isolate parent ions $m_1$. The parent ions $m_1$ are then fragmented by applying a discrete frequency component to form resultant fragment ions $m_2$. The resulting fragment ions $m_2$ are retained within the ion trap by virtue of the broadband notched signal having a frequency notch corresponding to $m_2$.

FIG. 11(b) of WO 00/33350 (Douglas) relates to an arrangement wherein a broadband notched waveform is applied in order to isolate triply charged parent ions having a mass to charge ratio of 587. The parent ions are fragmented to produce fragment ions as shown in FIG. 11(c). The dominant fragment ions having a mass to charge ratio of 726 are then isolated as shown in FIG. 11(d). First generation fragment ions having a mass to charge of 726 are then fragmented to form second generation fragment ions as shown in FIG. 11(e).

GB-2455692 (Makarov) discloses a method of operating a multi-reflection ion trap.

US 2009/0090860 (Furuhashi) discloses an ion trap mass spectrometer for $MS^n$ analysis.

GB-2421842 (Micromass) discloses a mass spectrometer with resonant ejection of unwanted ions.

GB-2452350 (Micromass) discloses a mass filter using a sequence of notched broadband frequency signals.

US 2010/0276583 (Senko) discloses a multi-resolution mass spectrometer system and intra-scanning method.

It is desired to provide an improved collision or reaction device for a mass spectrometer and an improved method of colliding or reacting ions.

SUMMARY OF THE PRESENT INVENTION

According to the present invention there is provided a collision or reaction device for a mass spectrometer comprising:

a first device arranged and adapted to cause first ions to collide or react with charged particles and/or neutral particles or otherwise dissociate so as to form second ions;

a second device arranged and adapted to apply a broadband excitation with one or more frequency notches to the first device so as to cause the second ions and/or ions derived from the second ions to be substantially ejected from the collision or reaction region; and a device arranged and adapted to determine the time when the second ions and/or ions derived from the second ions are substantially ejected from the first device.

The present invention relates to the temporal monitoring of gas phase reactions such as ion-ion, ion-electron, ion-molecule, ion-neutral and ion-metastable reactions. Parent or precursor ions are initially trapped before undergoing gas phase reactions or fragmentation. The resulting product ions are preferably automatically ejected and passed to an analytical device such as an orthogonal acceleration Time of Flight mass analyser, wherein the product ions are preferably further analysed. Alternatively, the product ions may undergo additional reactions or fragmentation stages before the analysis step.

The preferred embodiment may be implemented using a 3D or linear ion trap with the reaction products being transferred out of the device radially or axially into another analytical separation device.

In mass spectrometry a situation is often encountered where within the resolution of the various separation and analysis techniques employed it is not possible to differentiate between two or more different species. The preferred embodiment relates to an orthogonal method that probes the reaction kinetics of a process, for example fragmentation, to allow differentiation of the species in terms of their reaction times. In addition the preferred embodiment provides a novel method of probing such temporally differentiated processes.

The present invention has particular applicability for tandem quadrupole systems.

According to the preferred embodiment of the present invention different product or fragment ions are preferably generated at different times and this allows different species of parent or precursor ions located within the ion trap or collision or reaction device which may have substantially the same mass to charge ratio to be differentiated from one another.

An important aspect of the preferred embodiment, therefore, is that by measuring or determining the time at which fragment or product ions are auto-ejected from the ion trap or collision or reaction device enables different species of parent or precursor ions to be identified, recognised or otherwise determined and/or one or more physico-chemical properties of the parent or precursor ions to be determined.

The charged particles preferably comprise ions.

The collision or reaction device preferably comprises an ion-ion collision or reaction device.

The first ions are preferably caused to interact with reagent ions via Electron Transfer Dissociation ("ETD") so as to form the second ions.

According to a less preferred embodiment the charged particles comprise electrons.

The collision or reaction device preferably comprises an ion-electron collision or reaction device.

The collision or reaction device may comprise an ion-molecule collision or reaction device.

The first ions may be caused to interact with gas molecules and fragment via Collision Induced Dissociation ("CID") to form the second ions.

The first ions may be caused to interact with deuterium via Hydrogen-Deuterium exchange ("HDx") to form the second ions.

The collision or reaction device may comprise an ion-metastable collision or reaction device.

The collision or reaction device may comprise a gas phase collision or reaction device.

The collision or reaction device preferably comprises a linear or 2D ion trap.

The collision or reaction device preferably comprises a quadrupole rod set ion guide or ion trap.

The collision or reaction device may comprise a 3D ion trap.

The collision or reaction device preferably further comprises a device for applying a radially dependent trapping potential across at least a portion of the first device.

The collision or reaction device preferably further comprises a device arranged and adapted to maintain an axial DC voltage gradient and/or to apply one or more transient DC voltages to the first device in order to urge ions in a direction within the first device.

According to another aspect of the present invention there is provided a mass spectrometer comprising a collision or reaction device as described above.

According to another aspect of the present invention there is provided a method of colliding or reacting ions comprising:

providing a first device and causing first ions to collide or react with charged particles and/or neutral particles or otherwise dissociate so as to form second ions;

applying a broadband excitation with one or more frequency notches to the first device so as to cause the second ions and/or ions derived from the second ions to be substantially ejected from the first device; and determining the time when the second ions and/or ions derived from the second ions are substantially ejected from the first device.

According to another aspect of the present invention there is provided a method of mass spectrometry comprising a method of colliding or reacting ions as described above.

The collision or reaction device or ion trap preferably comprises:

a first electrode set comprising a first plurality of electrodes;

a second electrode set comprising a second plurality of electrodes;

a third device arranged and adapted to apply one or more DC voltages to one or more of the first plurality of electrodes and/or to one or more of the second plurality electrodes so that:

(a) ions having a radial displacement within a first range experience a DC trapping field, a DC potential barrier or a barrier field which acts to confine at least some of the ions in at least one axial direction within the ion trap or collision or reaction device; and (b) ions having a radial displacement within a second different range experience either: (i) a substantially zero DC trapping field, no DC potential barrier or no barrier field so that at least some of the ions are not confined in the at least one axial direction within the ion trap or collision or reaction device; and/or (ii) a DC extraction field, an accelerating DC potential difference or an extraction field which acts to extract or accelerate at least some of the ions in the at least one axial direction and/or out of the ion trap or collision or reaction device; and a fourth device arranged and adapted to vary, increase, decrease or alter the radial displacement of at least some ions within the ion trap or collision or reaction device.

The fourth device may be arranged:

(i) to cause at least some ions having a radial displacement which falls within the first range at a first time to have a radial displacement which falls within the second range at a second subsequent time; and/or (ii) to cause at least some ions having a radial displacement which falls within the second range at a first time to have a radial displacement which falls within the first range at a second subsequent time.

According to a less preferred embodiment either: (i) the first electrode set and the second electrode set comprise electrically isolated sections of the same set of electrodes and/or wherein the first electrode set and the second electrode set are formed mechanically from the same set of electrodes; and/or (ii) the first electrode set comprises a region of a set of electrodes having a dielectric coating and the second electrode set comprises a different region of the same set of electrodes; and/or (iii) the second electrode set comprises a region of a set of electrodes having a dielectric coating and the first electrode set comprises a different region of the same set of electrodes.

The second electrode set is preferably arranged downstream of the first electrode set. The axial separation between a downstream end of the first electrode set and an upstream end of the second electrode set is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-15 mm; (xii) 15-20 mm; (xiii) 20-25 mm; (xiv) 25-30 mm; (xv) 30-35 mm; (xvi) 35-40 mm; (xvii) 40-45 mm; (xviii) 45-50 mm; and (xix) >50 mm.

The first electrode set is preferably arranged substantially adjacent to and/or co-axial with the second electrode set.

The first plurality of electrodes preferably comprises a multipole rod set, a quadrupole rod set, a hexapole rod set, an octapole rod set or a rod set having more than eight rods. The second plurality of electrodes preferably comprises a multipole rod set, a quadrupole rod set, a hexapole rod set, an octapole rod set or a rod set having more than eight rods.

According to a less preferred embodiment the first plurality of electrodes may comprise a plurality of electrodes or at least 5, 10, 15, 20, 25, 30, 35, 40, 45, 50, 55, 60, 65, 70, 75, 80, 85, 90, 95, 100, 110, 120, 130, 140, 150, 160, 170, 180, 190 or 200 electrodes having apertures through which ions are transmitted in use. According to a less preferred embodiment the second plurality of electrodes may comprise a plurality of electrodes or at least 5, 10, 15, 20, 25, 30, 35, 40, 45, 50, 55, 60, 65, 70, 75, 80, 85, 90, 95, 100, 110, 120, 130, 140, 150, 160, 170, 180, 190 or 200 electrodes having apertures through which ions are transmitted in use.

According to the preferred embodiment the first electrode set has a first axial length and the second electrode set has a second axial length, and wherein the first axial length is substantially greater than the second axial length and/or wherein the ratio of the first axial length to the second axial length is at least 2, 3, 4, 5, 6, 7, 8, 9, 10, 11, 12, 13, 14, 15, 16, 17, 18, 19, 20, 25, 30, 35, 40, 45 or 50.

The third device is preferably arranged and adapted to apply one or more DC voltages to one or more of the first plurality of electrodes and/or to one or more of the second plurality of electrodes so as to create, in use, an electric potential within the first electrode set and/or within the second electrode set which increases and/or decreases and/or varies with radial displacement in a first radial direction as measured from a central longitudinal axis of the first electrode set and/or the second electrode set. The third device is preferably arranged and adapted to apply one or more DC voltages to one or more of the first plurality of electrodes and/or to one or more of the second plurality of electrodes so as to create, in use, an electric potential which increases and/or decreases and/or varies with radial displacement in a second radial direction as measured from a central longitudinal axis of the first electrode set and/or the second electrode set. The second radial direction is preferably orthogonal to the first radial direction.

According to the preferred embodiment the third device may be arranged and adapted to apply one or more DC voltages to one or more of the first plurality of electrodes and/or to one or more of the second plurality of electrodes so as to confine at least some positive and/or negative ions axially within the ion trap or collision or reaction device if the ions have a radial displacement as measured from a central longitudinal axis of the first electrode set and/or the second electrode set greater than or less than a first value.

According to the preferred embodiment the third device is preferably arranged and adapted to create, in use, one or more radially dependent axial DC potential barriers at one or more axial positions along the length of the ion trap or collision or reaction device. The one or more radially dependent axial DC potential barriers preferably substantially prevent at least some or at least 5%, 10%, 15%, 20%, 25%, 30%, 35%, 40%, 45%, 50%, 55%, 60%, 65%, 70%, 75%, 80%, 85%, 90% or 95% of positive and/or negative ions within the ion trap or collision or reaction device from passing axially beyond the one or more axial DC potential barriers and/or from being extracted axially from the ion trap or collision or reaction device.

The third device is preferably arranged and adapted to apply one or more DC voltages to one or more of the first plurality of electrodes and/or to one or more of the second plurality of electrodes so as to create, in use, an extraction field which preferably acts to extract or accelerate at least some positive and/or negative ions out of the ion trap or collision or reaction device if the ions have a radial displacement as measured from a central longitudinal axis of the first electrode and/or the second electrode greater than or less than a first value.

The third device is preferably arranged and adapted to create, in use, one or more axial DC extraction electric fields at one or more axial positions along the length of the ion trap or collision or reaction device. The one or more axial DC extraction electric fields preferably cause at least some or at least 5%, 10%, 15%, 20%, 25%, 30%, 35%, 40%, 45%, 50%, 55%, 60%, 65%, 70%, 75%, 80%, 85%, 90% or 95% of positive and/or negative ions within the ion trap or collision or reaction device to pass axially beyond the DC trapping field, DC potential barrier or barrier field and/or to be extracted axially from the ion trap, collision or reaction device.

According to the preferred embodiment the third device is arranged and adapted to create, in use, a DC trapping field, DC potential barrier or barrier field which acts to confine at least some of the ions in the at least one axial direction, and wherein the ions preferably have a radial displacement as measured from the central longitudinal axis of the first electrode set and/or the second electrode set within a range selected from the group consisting of: (i) 0-0.5 mm; (ii) 0.5-1.0 mm; (iii) 1.0-1.5 mm; (iv) 1.5-2.0 mm; (v) 2.0-2.5 mm; (vi) 2.5-3.0 mm; (vii) 3.0-3.5 mm; (viii) 3.5-4.0 mm; (ix) 4.0-4.5 mm; (x) 4.5-5.0 mm; (xi) 5.0-5.5 mm; (xii) 5.5-6.0 mm; (xiii) 6.0-6.5 mm; (xiv) 6.5-7.0 mm; (xv) 7.0-7.5 mm; (xvi) 7.5-8.0 mm; (xvii) 8.0-8.5 mm; (xviii) 8.5-9.0 mm; (xix) 9.0-9.5 mm; (xx) 9.5-10.0 mm; and (xxi) >10.0 mm.

According to the preferred embodiment the third device is arranged and adapted to provide a substantially zero DC trapping field, no DC potential barrier or no barrier field at at least one location so that at least some of the ions are not confined in the at least one axial direction within the ion trap or collision or reaction device, and wherein the ions preferably have a radial displacement as measured from the central longitudinal axis of the first electrode set and/or the second electrode set within a range selected from the group consisting of: (i) 0-0.5 mm; (ii) 0.5-1.0 mm; (iii) 1.0-1.5 mm; (iv) 1.5-2.0 mm; (v) 2.0-2.5 mm; (vi) 2.5-3.0 mm; (vii) 3.0-3.5 mm; (viii) 3.5-4.0 mm; (ix) 4.0-4.5 mm; (x) 4.5-5.0 mm; (xi) 5.0-5.5 mm; (xii) 5.5-6.0 mm; (xiii) 6.0-6.5 mm; (xiv) 6.5-7.0 mm; (xv) 7.0-7.5 mm; (xvi) 7.5-8.0 mm; (xvii) 8.0-8.5 mm; (xviii) 8.5-9.0 mm; (xix) 9.0-9.5 mm; (xx) 9.5-10.0 mm; and (xxi) >10.0 mm.

The third device is preferably arranged and adapted to create, in use, a DC extraction field, an accelerating DC potential difference or an extraction field which acts to extract or accelerate at least some of the ions in the at least one axial direction and/or out of the ion trap or collision or reaction device, and wherein the ions preferably have a radial displacement as measured from the central longitudinal axis of the first electrode set and/or the second electrode set within a range selected from the group consisting of: (i) 0-0.5 mm; (ii) 0.5-1.0 mm; (iii) 1.0-1.5 mm; (iv) 1.5-2.0 mm; (v) 2.0-2.5 mm; (vi) 2.5-3.0 mm; (vii) 3.0-3.5 mm; (viii) 3.5-4.0 mm; (ix) 4.0-4.5 mm; (x) 4.5-5.0 mm; (xi) 5.0-5.5 mm; (xii) 5.5-6.0 mm; (xiii) 6.0-6.5 mm; (xiv) 6.5-7.0 mm; (xv) 7.0-7.5 mm; (xvi) 7.5-8.0 mm; (xvii) 8.0-8.5 mm; (xviii) 8.5-9.0 mm; (xix) 9.0-9.5 mm; (xx) 9.5-10.0 mm; and (xxi) >10.0 mm.

The first plurality of electrodes preferably have an inscribed radius of r1 and a first longitudinal axis and/or wherein the second plurality of electrodes have an inscribed radius of r2 and a second longitudinal axis.

The third device is preferably arranged and adapted to create a DC trapping field, a DC potential barrier or a barrier field which acts to confine at least some of the ions in the at least one axial direction within the ion trap or collision or reaction device and wherein the DC trapping field, DC potential barrier or barrier field increases and/or decreases and/or varies with increasing radius or displacement in a first radial direction away from the first longitudinal axis and/or the second longitudinal axis up to at least 5%, 10%, 15%, 20%, 25%, 30%, 35%, 40%, 45%, 50%, 55%, 60%, 65%, 70%, 75%, 80%, 85%, 90%, 95% or 100% of the first inscribed radius r1 and/or the second inscribed radius r2.

The third device is preferably arranged and adapted to create a DC trapping field, DC potential barrier or barrier field which acts to confine at least some of the ions in the at least one axial direction within the ion trap or collision or reaction device and wherein the DC trapping field, DC potential barrier or barrier field increases and/or decreases and/or varies with increasing radius or displacement in a second radial direction away from the first longitudinal axis and/or the second longitudinal axis up to at least 5%, 10%, 15%, 20%, 25%, 30%, 35%, 40%, 45%, 50%, 55%, 60%, 65%, 70%, 75%, 80%, 85%, 90%, 95% or 100% of the first inscribed radius r1 and/or the second inscribed radius r2. The second radial direction is preferably orthogonal to the first radial direction.

The third device is preferably arranged and adapted to provide substantially zero DC trapping field, no DC potential barrier or no barrier field at at least one location so that at least some of the ions are not confined in the at least one axial direction within the ion trap or collision or reaction device and wherein the substantially zero DC trapping field, no DC potential barrier or no barrier field extends with increasing radius or displacement in a first radial direction away from the first longitudinal axis and/or the second longitudinal axis up to at least 5%, 10%, 15%, 20%, 25%, 30%, 35%, 40%, 45%, 50%, 55%, 60%, 65%, 70%, 75%, 80%, 85%, 90%, 95% or 100% of the first inscribed radius r1 and/or the second inscribed radius r2. The third device is preferably arranged and adapted to provide a substantially zero DC trapping field, no DC potential barrier or no barrier field at at least one location so that at least some of the ions are not confined in the at least one axial direction within the ion trap or collision or reaction device and wherein the substantially zero DC trapping field, no DC potential barrier or no barrier field extends with increasing radius or displacement in a second radial direction away from the first longitudinal axis and/or the second longitudinal axis up to at least 5%, 10%, 15%, 20%, 25%, 30%, 35%, 40%, 45%, 50%, 55%, 60%, 65%, 70%, 75%, 80%, 85%, 90%, 95% or 100% of the first inscribed radius r1 and/or the second inscribed radius r2. The second radial direction is preferably orthogonal to the first radial direction.

The third device is arranged and adapted to create a DC extraction field, an accelerating DC potential difference or an extraction field which acts to extract or accelerate at least some of the ions in the at least one axial direction and/or out of the ion trap or collision or reaction device and wherein the DC extraction field, accelerating DC potential difference or extraction field increases and/or decreases and/or varies with increasing radius or displacement in a first radial direction away from the first longitudinal axis and/or the second longitudinal axis up to at least 5%, 10%, 15%, 20%, 25%, 30%, 35%, 40%, 45%, 50%, 55%, 60%, 65%, 70%, 75%, 80%, 85%, 90%, 95% or 100% of the first inscribed radius r1 and/or the second inscribed radius r2. The third device is preferably arranged and adapted to create a DC extraction field, an accelerating DC potential difference or an extraction field which acts to extract or accelerate at least some of the ions in the at least one axial direction and/or out of the ion trap or collision or reaction device and wherein the DC extraction field, accelerating DC potential difference or extraction field increases and/or decreases and/or varies with increasing radius or displacement in a second radial direction away from the first longitudinal axis and/or the second longitudinal axis up to at least 5%, 10%, 15%, 20%, 25%, 30%, 35%, 40%, 45%, 50%, 55%, 60%, 65%, 70%, 75%, 80%, 85%, 90%, 95% or 100% of the first inscribed radius r1 and/or the second inscribed radius r2. The second radial direction is preferably orthogonal to the first radial direction.

According to the preferred embodiment the DC trapping field, DC potential barrier or barrier field which acts to confine at least some of the ions in the at least one axial direction within the ion trap or collision or reaction device is created at one or more axial positions along the length of the ion trap or collision or reaction device and at least at an distance x mm upstream and/or downstream from the axial centre of the first electrode set and/or the second electrode set, wherein x is preferably selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; (xiii) 20-25; (xiv) 25-30; (xv) 30-35; (xvi) 35-40; (xvii) 40-45; (xviii) 45-50; and (xix) >50.

According to the preferred embodiment the zero DC trapping field, the no DC potential barrier or the no barrier field is provided at one or more axial positions along the length of the ion trap or collision or reaction device and at least at an distance y mm upstream and/or downstream from the axial centre of the first electrode set and/or the second electrode set, wherein y is preferably selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; (xiii) 20-25; (xiv) 25-30; (xv) 30-35; (xvi) 35-40; (xvii) 40-45; (xviii) 45-50; and (xix) >50.

According to the preferred embodiment the DC extraction field, the accelerating DC potential difference or the extraction field which acts to extract or accelerate at least some of the ions in the at least one axial direction and/or out of the ion trap or collision or reaction device is created at one or more axial positions along the length of the ion trap or collision or reaction device and at least at an distance z mm upstream and/or downstream from the axial centre of the first electrode set and/or the second electrode set, wherein z is preferably selected from the group consisting of: (i) <1;

(ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; (xiii) 20-25; (xiv) 25-30; (xv) 30-35; (xvi) 35-40; (xvii) 40-45; (xviii) 45-50; and (xix) >50.

The third device is preferably arranged and adapted to apply the one or more DC voltages to one or more of the first plurality of electrodes and/or to one or more of the second plurality of electrodes so that either:

(i) the radial and/or the axial position of the DC trapping field, DC potential barrier or barrier field remains substantially constant whilst ions are being ejected axially from the ion trap or collision or reaction device in a mode of operation; and/or (ii) the radial and/or the axial position of the substantially zero DC trapping field, no DC potential barrier or no barrier field remains substantially constant whilst ions are being ejected axially from the ion trap or collision or reaction device in a mode of operation; and/or (iii) the radial and/or the axial position of the DC extraction field, accelerating DC potential difference or extraction field remains substantially constant whilst ions are being ejected axially from the ion trap or collision or reaction device in a mode of operation.

The third device is preferably arranged and adapted to apply the one or more DC voltages to one or more of the first plurality of electrodes and/or to one or more of the second plurality of electrodes so as to:

(i) vary, increase, decrease or scan the radial and/or the axial position of the DC trapping field, DC potential barrier or barrier field whilst ions are being ejected axially from the ion trap or collision or reaction device in a mode of operation; and/or (ii) vary, increase, decrease or scan the radial and/or the axial position of the substantially zero DC trapping field, no DC potential barrier or no barrier field whilst ions are being ejected axially from the ion trap or collision or reaction device in a mode of operation; and/or (iii) vary, increase, decrease or scan the radial and/or the axial position of the DC extraction field, accelerating DC potential difference or extraction field whilst ions are being ejected axially from the ion trap or collision or reaction device in a mode of operation.

The third device is preferably arranged and adapted to apply the one or more DC voltages to one or more of the first plurality of electrodes and/or to one or more of the second plurality of electrodes so that:

(i) the amplitude of the DC trapping field, DC potential barrier or barrier field remains substantially constant whilst ions are being ejected axially from the ion trap or collision or reaction device in a mode of operation; and/or (ii) the substantially zero DC trapping field, the no DC potential barrier or the no barrier field remains substantially zero whilst ions are being ejected axially from the ion trap or collision or reaction device in a mode of operation; and/or (iii) the amplitude of the DC extraction field, accelerating DC potential difference or extraction field remains substantially constant whilst ions are being ejected axially from the ion trap or collision or reaction device in a mode of operation.

According to an embodiment the third device is preferably arranged and adapted to apply the one or more DC voltages to one or more of the first plurality of electrodes and/or to one or more of the second plurality of electrodes so as to:

(i) vary, increase, decrease or scan the amplitude of the DC trapping field, DC potential barrier or barrier field whilst ions are being ejected axially from the ion trap or collision or reaction device in a mode of operation; and/or (ii) vary, increase, decrease or scan the amplitude of the DC extraction field, accelerating DC potential difference or extraction field whilst ions are being ejected axially from the ion trap or collision or reaction device in a mode of operation.

The fourth device is preferably arranged and adapted to apply a first phase and/or a second opposite phase of one or more excitation, AC or tickle voltages to at least some of the first plurality of electrodes and/or to at least some of the second plurality of electrodes in order to excite at least some ions in at least one radial direction within the first electrode set and/or within the second electrode set and so that at least some ions are subsequently urged in the at least one axial direction and/or are ejected axially from the ion trap or collision or reaction device and/or are moved past the DC trapping field, the DC potential or the barrier field. The ions which are urged in the at least one axial direction and/or are ejected axially from the ion trap or collision or reaction device and/or are moved past the DC trapping field, the DC potential or the barrier field preferably move along an ion path formed within the second electrode set.

The fourth device is preferably arranged and adapted to apply a first phase and/or a second opposite phase of one or more excitation, AC or tickle voltages to at least some of the first plurality of electrodes and/or to at least some of the second plurality of electrodes in order to excite in a mass or mass to charge ratio selective manner at least some ions radially within the first electrode set and/or the second electrode set to increase in a mass or mass to charge ratio selective manner the radial motion of at least some ions within the first electrode set and/or the second electrode set in at least one radial direction.

Preferably, the one or more excitation, AC or tickle voltages have an amplitude selected from the group consisting of: (i) <50 mV peak to peak; (ii) 50-100 mV peak to peak; (iii) 100-150 mV peak to peak; (iv) 150-200 mV peak to peak; (v) 200-250 mV peak to peak; (vi) 250-300 mV peak to peak; (vii) 300-350 mV peak to peak; (viii) 350-400 mV peak to peak; (ix) 400-450 mV peak to peak; (x) 450-500 mV peak to peak; and (xi) >500 mV peak to peak. Preferably, the one or more excitation, AC or tickle voltages have a frequency selected from the group consisting of: (i) <10 kHz; (ii) 10-20 kHz; (iii) 20-30 kHz; (iv) 30-40 kHz; (v) 40-50 kHz; (vi) 50-60 kHz; (vii) 60-70 kHz; (viii) 70-80 kHz; (ix) 80-90 kHz; (x) 90-100 kHz; (xi) 100-110 kHz; (xii) 110-120 kHz; (xiii) 120-130 kHz; (xiv) 130-140 kHz; (xv) 140-150 kHz; (xvi) 150-160 kHz; (xvii) 160-170 kHz; (xviii) 170-180 kHz; (xix) 180-190 kHz; (xx) 190-200 kHz; and (xxi) 200-250 kHz; (xxii) 250-300 kHz; (xxiii) 300-350 kHz; (xxiv) 350-400 kHz; (xxv) 400-450 kHz; (xxvi) 450-500 kHz; (xxvii) 500-600 kHz; (xxviii) 600-700 kHz; (xxix) 700-800 kHz; (xxx) 800-900 kHz; (xxxi) 900-1000 kHz; and (xxxii) >1 MHz.

According to the preferred embodiment the fourth device is arranged and adapted to maintain the frequency and/or amplitude and/or phase of the one or more excitation, AC or tickle voltages applied to at least some of the first plurality of electrodes and/or at least some of the second plurality of electrodes substantially constant.

According to the preferred embodiment the fourth device is arranged and adapted to vary, increase, decrease or scan the frequency and/or amplitude and/or phase of the one or more excitation, AC or tickle voltages applied to at least some of the first plurality of electrodes and/or at least some of the second plurality of electrodes.

The first electrode set preferably comprises a first central longitudinal axis and wherein:

(i) there is a direct line of sight along the first central longitudinal axis; and/or (ii) there is substantially no physical axial obstruction along the first central longitudinal axis; and/or (iii) ions transmitted, in use, along the first central longitudinal axis are transmitted with an ion transmission efficiency of substantially 100%.

The second electrode set preferably comprises a second central longitudinal axis and wherein:

(i) there is a direct line of sight along the second central longitudinal axis; and/or (ii) there is substantially no physical axial obstruction along the second central longitudinal axis; and/or (iii) ions transmitted, in use, along the second central longitudinal axis are transmitted with an ion transmission efficiency of substantially 100%.

According to the preferred embodiment the first plurality of electrodes have individually and/or in combination a first cross-sectional area and/or shape and wherein the second plurality of electrodes have individually and/or in combination a second cross-sectional area and/or shape, wherein the first cross-sectional area and/or shape is substantially the same as the second cross-sectional area and/or shape at one or more points along the axial length of the first electrode set and the second electrode set and/or wherein the first cross-sectional area and/or shape at the downstream end of the first plurality of electrodes is substantially the same as the second cross-sectional area and/or shape at the upstream end of the second plurality of electrodes.

According to a less preferred embodiment the first plurality of electrodes have individually and/or in combination a first cross-sectional area and/or shape and wherein the second plurality of electrodes have individually and/or in combination a second cross-sectional area and/or shape, wherein the ratio of the first cross-sectional area and/or shape to the second cross-sectional area and/or shape at one or more points along the axial length of the first electrode set and the second electrode set and/or at the downstream end of the first plurality of electrodes and at the upstream end of the second plurality of electrodes is selected from the group consisting of: (i) <0.50; (ii) 0.50-0.60; (iii) 0.60-0.70; (iv) 0.70-0.80; (v) 0.80-0.90; (vi) 0.90-1.00; (vii) 1.00-1.10; (viii) 1.10-1.20; (ix) 1.20-1.30; (x) 1.30-1.40; (xi) 1.40-1.50; and (xii) >1.50.

According to the preferred embodiment the ion trap or collision or reaction device preferably further comprises a first plurality of vane or secondary electrodes arranged between the first electrode set and/or a second plurality of vane or secondary electrodes arranged between the second electrode set.

The first plurality of vane or secondary electrodes and/or the second plurality of vane or secondary electrodes preferably each comprise a first group of vane or secondary electrodes arranged in a first plane and/or a second group of electrodes arranged in a second plane. The second plane is preferably orthogonal to the first plane.

The first groups of vane or secondary electrodes preferably comprise a first set of vane or secondary electrodes arranged on one side of the first longitudinal axis of the first electrode set and/or the second longitudinal axis of the second electrode set and a second set of vane or secondary electrodes arranged on an opposite side of the first longitudinal axis and/or the second longitudinal axis. The first set of vane or secondary electrodes and/or the second set of vane or secondary electrodes preferably comprises at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 45, 50, 55, 60, 65, 70, 75, 80, 85, 90, 95 or 100 vane or secondary electrodes.

The second groups of vane or secondary electrodes preferably comprise a third set of vane or secondary electrodes arranged on one side of the first longitudinal axis and/or the second longitudinal axis and a fourth set of vane or secondary electrodes arranged on an opposite side of the first longitudinal axis and/or the second longitudinal axis. The third set of vane or secondary electrodes and/or the fourth set of vane or secondary electrodes preferably comprises at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 45, 50, 55, 60, 65, 70, 75, 80, 85, 90, 95 or 100 vane or secondary electrodes.

Preferably, the first set of vane or secondary electrodes and/or the second set of vane or secondary electrodes and/or the third set of vane or secondary electrodes and/or the fourth set of vane or secondary electrodes are arranged between different pairs of electrodes forming the first electrode set and/or the second electrode set.

The ion trap or collision or reaction device preferably further comprises a sixth device arranged and adapted to apply one or more first DC voltages and/or one or more second DC voltages either: (i) to at least some of the vane or secondary electrodes; and/or (ii) to the first set of vane or secondary electrodes; and/or (iii) to the second set of vane or secondary electrodes; and/or (iv) to the third set of vane or secondary electrodes; and/or (v) to the fourth set of vane or secondary electrodes.

The one or more first DC voltages and/or the one or more second DC voltages preferably comprise one or more transient DC voltages or potentials and/or one or more transient DC voltage or potential waveforms.

The one or more first DC voltages and/or the one or more second DC voltages preferably cause:

(i) ions to be urged, driven, accelerated or propelled in an axial direction and/or towards an entrance or first region of the ion trap or collision or reaction device along at least a part of the axial length of the ion trap or collision or reaction device; and/or (ii) ions, which have been excited in at least one radial direction, to be urged, driven, accelerated or propelled in an opposite axial direction and/or towards an exit or second region of the ion trap or collision or reaction device along at least a part of the axial length of the ion trap or collision or reaction device.

The one or more first DC voltages and/or the one or more second DC voltages preferably have substantially the same amplitude or different amplitudes. The amplitude of the one or more first DC voltages and/or the one or more second DC voltages are preferably selected from the group consisting of: (i) <1 V; (ii) 1-2 V; (iii) 2-3 V; (iv) 3-4 V; (v) 4-5 V; (vi) 5-6 V; (vii) 6-7 V; (viii) 7-8 V; (ix) 8-9 V; (x) 9-10 V; (xi) 10-15 V; (xii) 15-20 V; (xiii) 20-25 V; (xiv) 25-30 V; (xv) 30-35 V; (xvi) 35-40 V; (xvii) 40-45 V; (xviii) 45-50 V; and (xix) >50 V.

The fourth device is preferably arranged and adapted to apply a first phase and/or a second opposite phase of one or more excitation, AC or tickle voltages either: (i) to at least some of the vane or secondary electrodes; and/or (ii) to the first set of vane or secondary electrodes; and/or (iii) to the second set of vane or secondary electrodes; and/or (iv) to the third set of vane or secondary electrodes; and/or (v) to the fourth set of vane or secondary electrodes; in order to excite at least some ions in at least one radial direction within the first electrode set and/or the second electrode set and so that at least some ions are subsequently urged in the at least one axial direction and/or ejected axially from the ion trap or collision or reaction device and/or moved past the DC trapping field, the DC potential or the barrier field.

The ions which are urged in the at least one axial direction and/or are ejected axially from the ion trap or collision or reaction device and/or are moved past the DC trapping field, the DC potential or the barrier field preferably move along an ion path formed within the second electrode set.

According to the preferred embodiment the fourth device is arranged and adapted to apply a first phase and/or a second opposite phase of one or more excitation, AC or tickle voltages either: (i) to at least some of the vane or secondary electrodes; and/or (ii) to the first set of vane or secondary electrodes; and/or (iii) to the second set of vane or secondary electrodes; and/or (iv) to the third set of vane or secondary electrodes; and/or (v) to the fourth set of vane or secondary electrodes; in order to excite in a mass or mass to charge ratio selective manner at least some ions radially within the first electrode set and/or the second electrode set to increase in a mass or mass to charge ratio selective manner the radial motion of at least some ions within the first electrode set and/or the second electrode set in at least one radial direction.

Preferably, the one or more excitation, AC or tickle voltages have an amplitude selected from the group consisting of: (i) <50 mV peak to peak; (ii) 50-100 mV peak to peak; (iii) 100-150 mV peak to peak; (iv) 150-200 mV peak to peak; (v) 200-250 mV peak to peak; (vi) 250-300 mV peak to peak; (vii) 300-350 mV peak to peak; (viii) 350-400 mV peak to peak; (ix) 400-450 mV peak to peak; (x) 450-500 mV peak to peak; and (xi) >500 mV peak to peak.

Preferably, the one or more excitation, AC or tickle voltages have a frequency selected from the group consisting of: (i) <10 kHz; (ii) 10-20 kHz; (iii) 20-30 kHz; (iv) 30-40 kHz; (v) 40-50 kHz; (vi) 50-60 kHz; (vii) 60-70 kHz; (viii) 70-80 kHz; (ix) 80-90 kHz; (x) 90-100 kHz; (xi) 100-110 kHz; (xii) 110-120 kHz; (xiii) 120-130 kHz; (xiv) 130-140 kHz; (xv) 140-150 kHz; (xvi) 150-160 kHz; (xvii) 160-170 kHz; (xviii) 170-180 kHz; (xix) 180-190 kHz; (xx) 190-200 kHz; and (xxi) 200-250 kHz; (xxii) 250-300 kHz; (xxiii) 300-350 kHz; (xxiv) 350-400 kHz; (xxv) 400-450 kHz; (xxvi) 450-500 kHz; (xxvii) 500-600 kHz; (xxviii) 600-700 kHz; (xxix) 700-800 kHz; (xxx) 800-900 kHz; (xxxi) 900-1000 kHz; and (xxxii) >1 MHz.

The fourth device may be arranged and adapted to maintain the frequency and/or amplitude and/or phase of the one or more excitation, AC or tickle voltages applied to at least some of the plurality of vane or secondary electrodes substantially constant.

The fourth device may be arranged and adapted to vary, increase, decrease or scan the frequency and/or amplitude and/or phase of the one or more excitation, AC or tickle voltages applied to at least some of the plurality of vane or secondary electrodes.

The first plurality of vane or secondary electrodes preferably have individually and/or in combination a first cross-sectional area and/or shape. The second plurality of vane or secondary electrodes preferably have individually and/or in combination a second cross-sectional area and/or shape. The first cross-sectional area and/or shape is preferably substantially the same as the second cross-sectional area and/or shape at one or more points along the length of the first plurality of vane or secondary electrodes and the second plurality of vane or secondary electrodes.

The first plurality of vane or secondary electrodes may have individually and/or in combination a first cross-sectional area and/or shape and wherein the second plurality of vane or secondary electrodes have individually and/or in combination a second cross-sectional area and/or shape. The ratio of the first cross-sectional area and/or shape to the second cross-sectional area and/or shape at one or more points along the length of the first plurality of vane or secondary electrodes and the second plurality of vane or secondary electrodes is selected from the group consisting of: (i) <0.50; (ii) 0.50-0.60; (iii) 0.60-0.70; (iv) 0.70-0.80; (v) 0.80-0.90; (vi) 0.90-1.00; (vii) 1.00-1.10; (viii) 1.10-1.20; (ix) 1.20-1.30; (x) 1.30-1.40; (xi) 1.40-1.50; and (xii) >1.50.

The ion trap or collision or reaction device preferably further comprises a fifth device arranged and adapted to apply a first AC or RF voltage to the first electrode set and/or a second AC or RF voltage to the second electrode set. The first AC or RF voltage and/or the second AC or RF voltage preferably create a pseudo-potential well within the first electrode set and/or the second electrode set which acts to confine ions radially within the ion trap.

The first AC or RF voltage and/or the second AC or RF voltage preferably have an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The first AC or RF voltage and/or the second AC or RF voltage preferably have a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to the preferred embodiment the first AC or RF voltage and the second AC or RF voltage have substantially the same amplitude and/or the same frequency and/or the same phase.

According to a less preferred embodiment the fifth device may be arranged and adapted to maintain the frequency and/or amplitude and/or phase of the first AC or RF voltage and/or the second AC or RF voltage substantially constant.

According to the preferred embodiment the fifth device is arranged and adapted to vary, increase, decrease or scan the frequency and/or amplitude and/or phase of the first AC or RF voltage and/or the second AC or RF voltage.

According to an embodiment the fourth device is arranged and adapted to excite ions by resonance ejection and/or mass selective instability and/or parametric excitation.

The fourth device is preferably arranged and adapted to increase the radial displacement of ions by applying one or more DC potentials to at least some of the first plurality of electrodes and/or the second plurality of electrodes.

The ion trap or collision or reaction device preferably further comprises one or more electrodes arranged upstream and/or downstream of the first electrode set and/or the second electrode set, wherein in a mode of operation one or more DC and/or AC or RF voltages are applied to the one or more electrodes in order to confine at least some ions axially within the ion trap or collision or reaction device.

In a mode of operation at least some ions are preferably arranged to be trapped or isolated in one or more upstream and/or intermediate and/or downstream regions of the ion trap or collision or reaction device.

In a mode of operation at least some ions are preferably arranged to be fragmented in one or more upstream and/or intermediate and/or downstream regions of the ion trap or collision or reaction device. The ions are preferably arranged to be fragmented by: (i) Collisional Induced Dissociation ("CID"); (ii) Surface Induced Dissociation ("SID"); (iii) Electron Transfer Dissociation; (iv) Electron Capture Dissociation; (v) Electron Collision or Impact Dissociation; (vi) Photo Induced Dissociation ("PID"); (vii) Laser Induced Dissociation; (viii) infrared radiation induced dissociation; (ix) ultraviolet radiation induced dissociation; (x) thermal or temperature dissociation; (xi) electric field induced dissociation; (xii) magnetic field induced dissociation; (xiii) enzyme digestion or enzyme degradation dissociation; (xiv) ion-ion reaction dissociation; (xv) ion-molecule reaction dissociation; (xvi) ion-atom reaction dissociation; (xvii) ion-metastable ion reaction dissociation; (xviii) ion-metastable molecule reaction dissociation; (xix) ion-metastable atom reaction dissociation; and (xx) Electron Ionisation Dissociation ("EID").

According to an embodiment the ion trap or collision or reaction device is maintained, in a mode of operation, at a pressure selected from the group consisting of: (i) >100 mbar; (ii) >10 mbar; (iii) >1 mbar; (iv) >0.1 mbar; (v) $>10^{-2}$ mbar; (vi) $>10^{-3}$ mbar; (vii) $>10^{-4}$ mbar; (viii) $>10^{-5}$ mbar; (ix) $>10^{-6}$ mbar; (x) <100 mbar; (xi) <10 mbar; (xii) <1 mbar; (xiii) <0.1 mbar; (xiv) $<10^{-2}$ mbar; (xv) $<10^{-3}$ mbar; (xvi) $<10^{-4}$ mbar; (xvii) $<10^{-5}$ mbar; (xviii) $<10^{-6}$ mbar; (xix) 10-100 mbar; (xx) 1-10 mbar; (xxi) 0.1-1 mbar; (xxii) $10^{-2}$ to $10^{-1}$ mbar; (xxiii) $10^{-3}$ to $10^{-2}$ mbar; (xxiv) $10^{-4}$ to $10^{-3}$ mbar; and (xxv) $10^{-5}$ to $10^{-4}$ mbar.

In a mode of operation at least some ions are preferably arranged to be separated temporally according to their ion mobility or rate of change of ion mobility with electric field strength as they pass along at least a portion of the length of the ion trap or collision or reaction device.

According to an embodiment the ion trap or collision or reaction device preferably further comprises a device or ion gate for pulsing ions into the ion trap or collision or reaction device and/or for converting a substantially continuous ion beam into a pulsed ion beam.

According to an embodiment the first electrode set and/or the second electrode set are axially segmented in a plurality of axial segments or at least 2, 3, 4, 5, 6, 7, 8, 9, 10, 11, 12, 13, 14, 15, 16, 17, 18, 19 or 20 axial segments. In a mode of operation at least some of the plurality of axial segments are preferably maintained at different DC potentials and/or wherein one or more transient DC potentials or voltages or one or more transient DC potential or voltage waveforms are applied to at least some of the plurality of axial segments so that at least some ions are trapped in one or more axial DC potential wells and/or wherein at least some ions are urged in a first axial direction and/or a second opposite axial direction.

In a mode of operation: (i) ions are ejected substantially adiabatically from the ion trap or collision or reaction device in an axial direction and/or without substantially imparting axial energy to the ions; and/or (ii) ions are ejected axially from the ion trap or collision or reaction device in an axial direction with a mean axial kinetic energy in a range selected from the group consisting of: (i) <1 eV; (ii) 1-2 eV; (iii) 2-3 eV; (iv) 3-4 eV; (v) 4-5 eV; (vi) 5-6 eV; (vii) 6-7 eV; (viii) 7-8 eV; (ix) 8-9 eV; (x) 9-10 eV; (xi) 10-15 eV; (xii) 15-20 eV; (xiii) 20-25 eV; (xiv) 25-30 eV; (xv) 30-35 eV; (xvi) 35-40 eV; and (xvii) 40-45 eV; and/or (iii) ions are ejected axially from the ion trap or collision or reaction device in an axial direction and wherein the standard deviation of the axial kinetic energy is in a range selected from the group consisting of: (i) <1 eV; (ii) 1-2 eV; (iii) 2-3 eV; (iv) 3-4 eV; (v) 4-5 eV; (vi) 5-6 eV; (vii) 6-7 eV; (viii) 7-8 eV; (ix) 8-9 eV; (x) 9-10 eV; (xi) 10-15 eV; (xii) 15-20 eV; (xiii) 20-25 eV; (xiv) 25-30 eV; (xv) 30-35 eV; (xvi) 35-40 eV; (xvii) 40-45 eV; and (xviii) 45-50 eV.

According to an embodiment in a mode of operation multiple different species of ions having different mass to charge ratios are simultaneously ejected axially from the ion trap or collision or reaction device in substantially the same and/or substantially different axial directions.

In a mode of operation an additional AC voltage may be applied to at least some of the first plurality of electrodes and/or at least some of the second plurality of electrodes. The one or more DC voltages are preferably modulated on the additional AC voltage so that at least some positive and negative ions are simultaneously confined within the ion trap or collision or reaction device and/or simultaneously ejected axially from the ion trap or collision or reaction device. Preferably, the additional AC voltage has an amplitude selected from the group consisting of: (i) <1 V peak to peak; (ii) 1-2 V peak to peak; (iii) 2-3 V peak to peak; (iv) 3-4 V peak to peak; (v) 4-5 V peak to peak; (vi) 5-6 V peak to peak; (vii) 6-7 V peak to peak; (viii) 7-8 V peak to peak; (ix) 8-9 V peak to peak; (x) 9-10 V peak to peak; and (xi) >10 V peak to peak. Preferably, the additional AC voltage has a frequency selected from the group consisting of: (i) <10 kHz; (ii) 10-20 kHz; (iii) 20-30 kHz; (iv) 30-40 kHz; (v) 40-50 kHz; (vi) 50-60 kHz; (vii) 60-70 kHz; (viii) 70-80 kHz; (ix) 80-90 kHz; (x) 90-100 kHz; (xi) 100-110 kHz; (xii) 110-120 kHz; (xiii) 120-130 kHz; (xiv) 130-140 kHz; (xv) 140-150 kHz; (xvi) 150-160 kHz; (xvii) 160-170 kHz; (xviii) 170-180 kHz; (xix) 180-190 kHz; (xx) 190-200 kHz; and (xxi) 200-250 kHz; (xxii) 250-300 kHz; (xxiii) 300-350 kHz; (xxiv) 350-400 kHz; (xxv) 400-450 kHz; (xxvi) 450-500 kHz; (xxvii) 500-600 kHz; (xxviii) 600-700 kHz; (xxix) 700-800 kHz; (xxx) 800-900 kHz; (xxxi) 900-1000 kHz; and (xxxii) >1 MHz.

The ion trap or collision or reaction device is also preferably arranged and adapted to be operated in at least one non-trapping mode of operation wherein either:

(i) DC and/or AC or RF voltages are applied to the first electrode set and/or to the second electrode set so that the ion trap or collision or reaction device operates as an RF-only ion guide or ion guide wherein ions are not confined axially within the ion guide; and/or (ii) DC and/or AC or RF voltages are applied to the first electrode set and/or to the second electrode set so that the ion trap or collision or reaction device operates as a mass filter or mass analyser in order to mass selectively transmit some ions whilst substantially attenuating other ions.

According to a less preferred embodiment in a mode of operation ions which are not desired to be axially ejected at an instance in time may be radially excited and/or ions which are desired to be axially ejected at an instance in time are no longer radially excited or are radially excited to a lesser degree.

Ions which are desired to be axially ejected from the ion trap or collision or reaction device at an instance in time are preferably mass selectively ejected from the ion trap or collision or reaction device and/or ions which are not desired to be axially ejected from the ion trap or collision or reaction device at the instance in time are preferably not mass selectively ejected from the ion trap or collision or reaction device.

According to the preferred embodiment the first electrode set preferably comprises a first multipole rod set (e.g. a quadrupole rod set) and the second electrode set preferably comprises a second multipole rod set (e.g. a quadrupole rod set). Substantially the same amplitude and/or frequency and/or phase of an AC or RF voltage is preferably applied to the first multipole rod set and to the second multipole rod set in order to confine ions radially within the first multipole rod set and/or the second multipole rod set.

According to an aspect of the present invention there is provided an ion trap or collision or reaction device comprising:

a third device arranged and adapted to create a first DC electric field which acts to confine ions having a first radial displacement axially within the ion trap or collision or reaction device and a second DC electric field which acts to extract or axially accelerate ions having a second radial displacement from the ion trap or collision or reaction device; and a fourth device arranged and adapted to mass selectively vary, increase, decrease or scan the radial displacement of at least some ions so that the ions are ejected axially from the ion trap or collision or reaction device whilst other ions remains confined axially within the ion trap or collision or reaction device.

According to a particularly preferred embodiment the ion trap or collision or reaction device comprises:

a first electrode set comprising a first plurality of electrodes, wherein the first plurality of electrodes preferably comprises a first quadrupole rod set;

a second electrode set comprising a second plurality of electrodes, wherein the second plurality of electrodes preferably comprises a second quadrupole rod set, wherein the second electrode set is arranged downstream of the first electrode set;

a first device arranged and adapted to apply two DC voltages to the second quadrupole rod set;

a second device arranged and adapted to vary, increase, decrease or alter the radial displacement of at least some ions within the ion trap or collision or reaction device;

wherein:

the second device is preferably arranged and adapted to apply a first phase and/or a second opposite phase of one or more excitation, AC or tickle voltages to at least some of the first plurality of electrodes in order to excite in a mass or mass to charge ratio selective manner at least some ions radially within the first electrode set so as to increase in a mass or mass to charge ratio selective manner the radial motion of at least some ions within the first electrode set in at least one radial direction; and the first device is preferably arranged and adapted to apply the two DC voltages to the second quadrupole rod set so as to create a radially dependent axial DC potential barrier so that: (a) ions having a radial displacement within a first range experience a DC trapping field, a DC potential barrier or a barrier field which acts to confine at least some of the ions in at least one axial direction within the ion trap; and (b) ions having a radial displacement within a second different range experience a DC extraction field, an accelerating DC potential difference or an extraction field which acts to extract or accelerate at least some of the ions in the at least one axial direction and/or out of the ion trap or collision or reaction device.

According to the preferred embodiment ions are preferably ejected axially from the ion trap or collision or reaction device in an axial direction and wherein the standard deviation of the axial kinetic energy is preferably in a range selected from the group consisting of: (i) <1 eV; (ii) 1-2 eV; and (iii) 2-3 eV.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

A preferred embodiment of the present invention will now be described.

Figure 1:
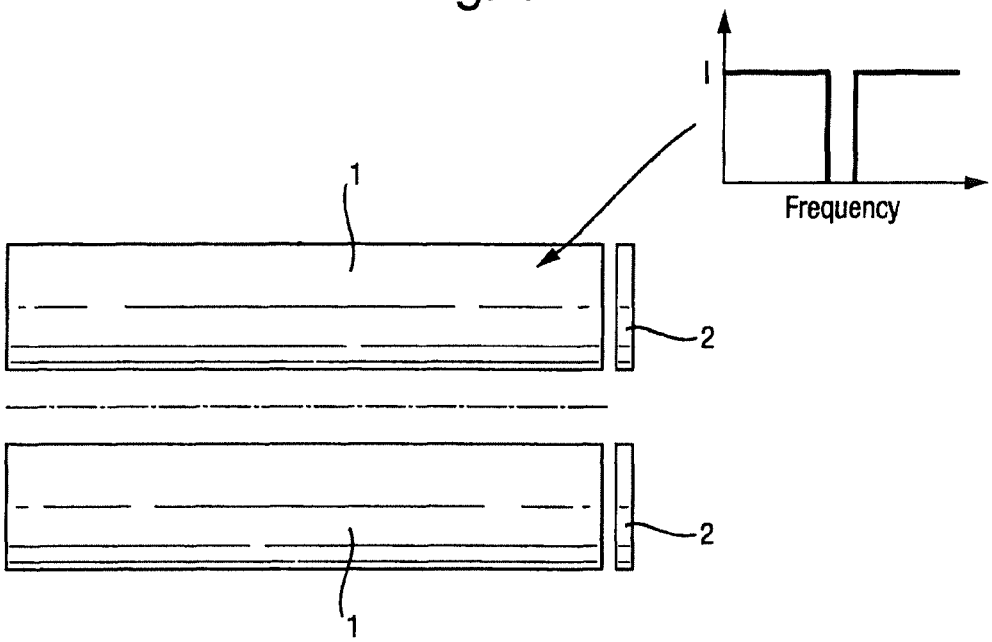
FIG. 1 shows an ion guide, ion trap or collision or reaction device according to an embodiment of the present invention.

According to a preferred embodiment a quadrupole rod set ion guide is preferably provided as shown in FIG. 1 comprising four rod electrodes 1. Trap electrodes 2 are preferably provided at an exit region and ions are preferably confined within the ion guide in a radially dependent manner.

A radial dependent barrier (as disclosed, for example, in US 2007/10181804 and GB-467466) is preferably provided by applying appropriate voltages to the trap electrodes 2.

A broadband excitation containing missing frequencies or notches is preferably applied to the electrodes 1 in order to radially excite a plurality ions in a manner such as is disclosed, for example, in U.S. Pat. No. 5,324,939 and WO 2006/054101. The ions which are radially excited are not lost to the rods 1 but instead are preferably axially ejected and are preferably transported to a downstream mass analyser.

In use parent or precursor ions are preferably introduced into the quadrupole ion guide or ion trap and a radially dependent trapping potential is preferably applied or otherwise maintained in order to confine the parent or precursor ions within the ion guide or ion trap. A broadband excitation having frequency components missing in its frequency spectrum which correspond to the secular frequency of the parent or precursor ions is preferably applied to the electrodes 1 of the ion guide. Ions may be pulsed into the device from an upstream mass to charge ratio filter (not shown).

According to a less preferred embodiment the ion guide preferably also contain reagent molecules in the case of an ion-molecule reaction.

According to another embodiment, reagent ions may be introduced and one or more additional frequency notches may be provided in the excitation frequencies applied to the quadrupole ion guide rods so that the reagent ions are not ejected.

Figure 2A:
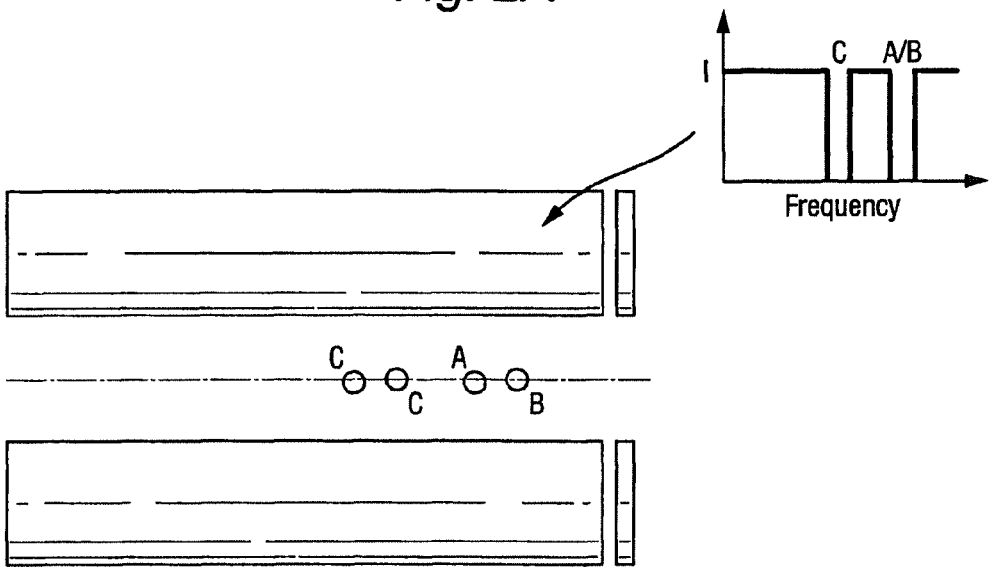
FIG. 2A shows an embodiment wherein different species of analyte ions are arranged to interact with reagent ions.

FIG. 2A shows a schematic of an ion-ion reaction such as Electron Transfer Dissociation ("ETD") according to an embodiment of the present invention. Two parent or precursor ions A,B preferably having similar mass to charge ratios may fragment to give different product or fragment ions D,E and the different reaction times can be measured by measuring the time taken for either of these product or fragment ions to form and preferably be auto-ejected from the ion guide, ion trap or collision or reaction device.

With reference to FIG. 2A two parent or precursor ions A,B preferably having similar mass to charge ratio are shown being introduced into the ion guide, ion trap or collision or reaction device and are preferably trapped on the centre line. Reagent ions C of opposite polarity are also preferably introduced into the ion guide, ion trap or collision or reaction device and preferably interact with the analyte ions A,B. If the reaction time of parent or precursor ions A with reagent ions C is shorter than the reaction time of parent or precursor ions B with reagent ions C then initially parent or precursor ions A will interact with reagent ions C and will fragment to form first fragment ions D.

Figure 2B:
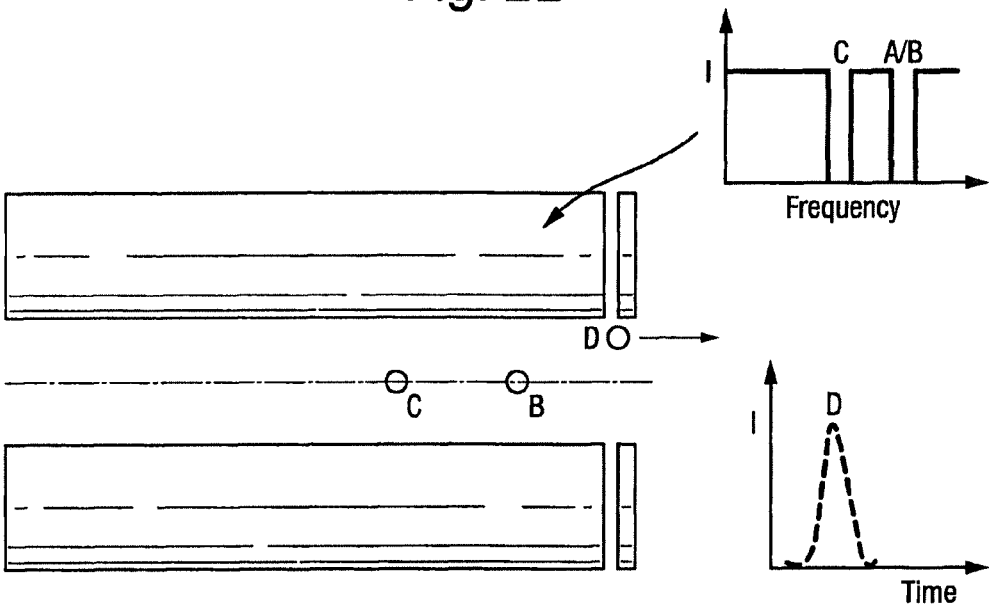
FIG. 2B shows initial first fragment ions being axially ejected at a first time and FIG. 2C shows subsequent second fragment ions which are formed after a longer interaction time than the first fragment ions being axially ejected at a second later time.

First fragment ions D are preferably produced and are preferably ejected from the ion guide, ion trap or collision or reaction device before parent or precursor ions B react with the reagent ions C as shown in FIG. 2B.

Figure 2C:
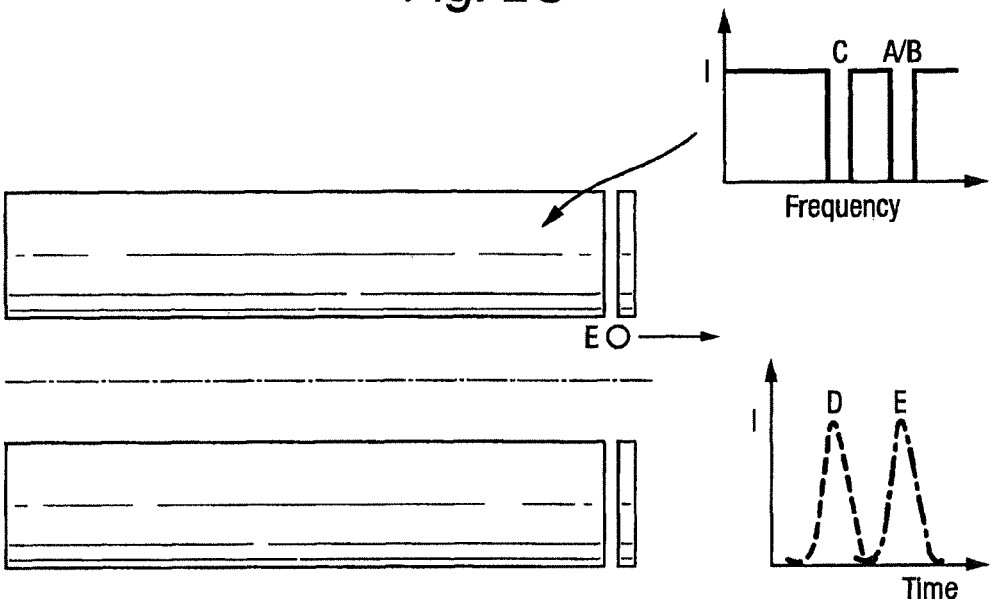

The time taken for parent or precursor ions A to interact with reagent ions C may be measured by monitoring the appearance time of first product or fragment ions D of the reaction. Similarly, the time taken for parent or precursor ions B to react with reagent ions C and fragment to form second or further fragment ions E may also be determined as shown in FIG. 2C.

Once either precursor ions A,B have reacted with the reagent ions C to form fragment ions D,E, the fragment ions D,E are preferably radially excited and efficiently removed/ejected from the ion guide, ion trap or collision or reaction device. The fragment ions may be analysed by a downstream analyser and the corresponding reaction time(s) may be determined.

When not in use the system preferably operates as normal with no detrimental effects to for example resolution or sensitivity.

According to an embodiment a gas phase Hydrogen-Deuterium exchange ("HDx") experiment may be performed wherein the broadband excitation may be applied with missing frequencies corresponding to the mass to charge ratio of the analyte ions. By applying additional missing frequencies the exchange reaction may be forced to continue until a predetermined number of exchanges have occurred. Probing the time taken to reach this number of exchanges preferably yields information about conformations that would otherwise be unavailable. Alternatively, a single frequency or small band of frequencies may be applied to cause ejection of the targeted Hydrogen-Deuterium exchange species.

It is also possible to monitor reaction times in Collision Induced Dissociation ("CID") based experiments by appropriate choice of the 'directions of tickle' in devices with radially and directionally dependent barriers.

Alternatively or additionally, the temporal profile may be used as a means of separating a mixture of parent or precursor ions. For example, if more than one parent or precursor exists within an isolation window and they have different reactions times or profiles then this difference may be utilised to separate the parent or precursor ions.

In another mode of operation the reaction products are preferably removed only when multiple or targeted reactions have taken place.

Other ion reactions such as photo-dissociation can also be used for this method.

Other methods of auto-ejection such as RF based instability may also be used.

Other ion traps such as flat traps with quadratic DC wells may also be used.

Although the present invention has been described with reference to preferred embodiments, it will be understood by those skilled in the art that various changes in form and detail may be made without departing from the scope of the invention as set forth in the accompanying claims.

The invention claimed is:

1. A collision or reaction device for a mass spectrometer comprising:

a first device arranged and adapted to cause first ions to collide or react with charged particles or neutral particles or otherwise dissociate in a collision or reaction region so as to form second ions;

a second device arranged and adapted to apply a broadband excitation with one or more frequency notches to said first device so as to cause said second ions or ions derived from said second ions to be substantially ejected from said collision or reaction region; and a device arranged and adapted to determine when said second ions or ions derived from said second ions are substantially ejected from said first device.

2. A collision or reaction device as claimed in claim 1, wherein said charged particles comprise ions.

3. A collision or reaction device as claimed in claim 2, wherein said collision or reaction device comprises an ion-ion collision or reaction device.

4. A collision or reaction device as claimed in claim 3, wherein said first ions are caused to interact with reagent ions via Electron Transfer Dissociation ("ETD") so as to form said second ions.

5. A collision or reaction device as claimed in claim 1, wherein said charged particles comprise electrons.

6. A collision or reaction device as claimed in claim 5, wherein said collision or reaction device comprises an ion-electron collision or reaction device.

7. A collision or reaction device as claimed in claim 1, wherein said collision or reaction device comprises an ion-molecule collision or reaction device.

8. A collision or reaction device as claimed in claim 7, wherein said first ions are caused to interact with gas molecules and fragment via Collision Induced Dissociation ("CID") to form said second ions.

9. A collision or reaction device as claimed in claim 7, wherein said first ions are caused to interact with deuterium via Hydrogen-Deuterium exchange ("HDx") to form said second ions.

10. A collision or reaction device as claimed in claim 1, wherein said collision or reaction device comprises an ion-metastable collision or reaction device.

11. A collision or reaction device as claimed in claim 1, wherein said collision or reaction device comprises a gas phase collision or reaction device.

12. A collision or reaction device as claimed in claim 1, wherein said collision or reaction device comprises a linear or 2D ion trap.

13. A collision or reaction device as claimed in claim 12, wherein said collision or reaction device comprises a quadrupole rod set ion guide or ion trap.

14. A collision or reaction device as claimed in claim 1, wherein said collision or reaction device comprises a 3D ion trap.

15. A collision or reaction device as claimed in claim 1, further comprising a device for applying a radially dependent trapping potential across at least a portion of said first device.

16. A collision or reaction device as claimed in claim 1, further comprising a device arranged and adapted to maintain an axial DC voltage gradient or to apply one or more transient DC voltages to said first device in order to urge ions in a direction within said first device.

17. A mass spectrometer comprising a collision or reaction device as claimed in claim 1.

18. A method of colliding or reacting ions with a first device, said method comprising:

causing first ions to collide or react with charged particles or neutral particles or otherwise dissociate in a collision or reaction region of said first device so as to form second ions;

applying a broadband excitation with one or more frequency notches to said first device so as to cause said second ions or ions derived from said second ions to be substantially ejected from said collision or reaction region of said first device; and determining when said second ions or ions derived from said second ions are substantially ejected from said first device.

19. A method of mass spectrometry comprising a method of colliding or reacting ions as claimed in claim 18.

* * * * *